US007186163B2

(12) United States Patent
Carlucci

(10) Patent No.: US 7,186,163 B2
(45) Date of Patent: Mar. 6, 2007

(54) BLOUSE AND BRASSIERE COMBINATION

(76) Inventor: Robin A. Carlucci, 1513 Westchester Blvd., Westchester, IL (US) 60154

( * ) Notice: Subject to any disclaimer, the term of this patent is extended or adjusted under 35 U.S.C. 154(b) by 33 days.

(21) Appl. No.: 11/171,705

(22) Filed: Jun. 30, 2005

(65) Prior Publication Data

US 2007/0004314 A1 Jan. 4, 2007

(51) Int. Cl.
*A41C 3/08* (2006.01)
*A41C 3/06* (2006.01)

(52) U.S. Cl. ..... 450/28; 450/31; 450/33

(58) Field of Classification Search ..... 450/28, 450/30–33, 7–11, 14–17, 86, 88, 54–58; 2/105, 106, 113, 73, 78.1–78.4, 115, 69, 79, 2/243.1

See application file for complete search history.

(56) References Cited

U.S. PATENT DOCUMENTS 1,164,642 A * 12/1915 Guinzburg ..... 450/30

1,254,043 A * 1/1918 James ..... 450/31

* cited by examiner

*Primary Examiner*—Gloria M. Hale
(74) *Attorney, Agent, or Firm*—Wood, Phillips, Katz, Clark & Mortimer

(57) ABSTRACT

A garment for a woman, including a brassiere and a front opening blouse. The brassiere has a left and right cup connected by a back strap, a releasable front connection between the left and right cup, left and right shoulder straps releasably connecting the back strap and the left and right cups respectively, and a first attachment along the upper edge of the cups between the left and right straps. At least one of the left and right cups includes a pocket for supporting a breast prosthesis. The blouse includes a neckline adapted to substantially align with the upper edge of the brassiere cups, passages in the shoulders of the blouse through which the shoulder straps releasably extend, and a second attachment along the blouse neckline and adapted to secure to the upper edge of the cups.

12 Claims, 3 Drawing Sheets

BLOUSE AND BRASSIERE COMBINATION

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention is directed toward women's clothing, and particularly toward a combination of a blouse and brassiere.

BACKGROUND OF THE INVENTION AND TECHNICAL PROBLEMS POSED BY THE PRIOR ART

Appearing attractive, and feeling attractive, is a goal of many in choosing what they wear. While some people may attribute this to vanity, in fact one's self image and emotional well being can be related to their feelings about how they look. Whether or not that is as a result of societal pressure, and whether or not that pressure is fair, it is still a fact.

Moreover, the desire to feel attractive may in many instances be acutely and understandably strong, for example, in the situation where a woman has had either a single or double mastectomy. When a woman has a mastectomy, she faces many difficult emotional issues, including her mortality, based on the physical condition such as breast cancer which gave rise to the need for the mastectomy. Obviously, among the other issues is a concern for how she is perceived by others, with there being a strong desire to not want to feel "different", to just be "normal" again, and her appearance (including her perception of her appearance) can have a significant impact on that.

Of course, women who have had single and double mastectomies face physical as well as emotional challenges. For example, the mastectomy procedure can cause the woman to lose mobility and strength in her upper body and arms. Further, the woman may be left with pain which may further make it difficult to move her arms as she did before the surgery. As a result, it is often not only difficult and frustrating, but in some cases even physically impossible to put on or take off clothing items over her head, or which button anywhere but in the front. This effectively limits the garments which are available for her to wear, at a time when self image and confidence may most require that she be able to wear attractive clothes and feel attractive.

It should also be appreciated that while brassieres which support prosthesis are well known and available, the upper part of such brassieres tends to be higher on the woman's upper chest (e.g., while there are some prosthesis supporting brassieres which are low cut relative to other prosthesis supporting brassieres, even those are cut relatively higher than normal "low cut" brassieres). As a result, women wearing such brassieres have essentially been required to wear blouses with relatively high neck lines, with their apparel choices in the marketplace heretofore severely limited. While blouses with high neck lines can certainly be fashionable and attractive in their own right, women in such situations could have their self esteem and emotional health boosted appreciably by being able to wear something lower cut, pretty and alluring, not only because it feels good to feel attractive to others, but also because it helps them to feel that, despite their surgery, they are still normal, desirable women who have not forever lost that part of their previous life. In this respect, it should also be appreciated that even among those women whose husbands and friends truly believe they are as beautiful as they ever were, the nature of the situation, and particularly the unease which the women will almost unavoidably feel about themselves, leaves genuine emotional unease about their appearance.

Moreover, while prosthesis supporting brassieres are often higher than other brassieres though not up to the neckline, this does not mean that the woman may wear tops or blouses which are cut down to the top of the brassiere. That is, blouses which the woman may comfortably wear not only must typically be buttoned up the front, but they must also be relatively loosely fitting. Certainly, it is difficult to wear a tightly fitting blouse, as such blouses or tops are almost universally of a stretch type requiring that they be put on (and taken off) over the woman's head, which may be difficult if not impossible as previously noted. As a result, however, the loosely fitting (comfortable) blouse will fall away from the woman (e.g., when she bends forward), creating a gap allowing someone in front of her to see inside the blouse. This condition is undesirable for women of all conditions, with or without mastectomies. In order to protect against this, the blouses have been required to have a significantly higher (less revealing) neckline than the top of the brassiere.

The present invention is directed toward overcoming one or more of the problems set forth above.

SUMMARY OF THE INVENTION

According to one aspect of the present invention, a garment for a woman is provided, including a brassiere and a front opening blouse. The brassiere has a left and right cup connected by a back strap, a releasable front connection between the left and right cup, left and right shoulder straps between the back strap and the left and right cups respectively, and a first attachment along the upper edge of the cups between the left and right straps. The blouse includes a neckline adapted to substantially align with the upper edge of the brassiere cups, and a second attachment along the blouse neckline and adapted to secure to the upper edge of the cups.

In one form of this aspect of the present invention, the first attachment comprises a plurality of buttonholes adjacent the upper edge of the cups, and the second attachment comprises buttons aligned with the buttonholes. In a further form, a panel is behind the cup upper edge, whereby the panel is disposed between the buttons and the skin of a woman wearing the garment.

In another form of this aspect of the present invention, the left and right shoulder straps are releasably attached to the cups, and there are aligned passages in the shoulders of the blouse through which the shoulder straps releasably extend.

In still another form of this aspect of the present invention, lace is provided along the upper edge of the cups.

In yet another form of this aspect of the present invention, at least one of the left and right cups include a pocket for supporting a breast prosthesis.

In still another form of this aspect of the present invention, a second layer of material is provided along the blouse neckline, with the second layer of material adapted to hide indications of the first and second attachment through the blouse.

In another aspect of the present invention, a garment for a woman is provided, including a brassiere and a front opening blouse. The brassiere has a left and right cup connected by a back strap, a releasable front connection between the left and right cup, left and right shoulder straps releasably connecting the back strap and the left and right cups respectively, and a first attachment along the upper edge of the cups between the left and right straps. At least one of the left and right cups includes a pocket for supporting a breast prosthesis. The blouse includes a neckline adapted to substantially align with the upper edge of the brassiere cups, passages in the shoulders of the blouse through which the shoulder straps releasably extend, and a second attachment along the blouse neckline and adapted to secure to the upper edge of the cups.

In one form of this aspect of the present invention, the first attachment is a plurality of buttonholes adjacent the upper edge of the cups, and the second attachment is buttons aligned with the buttonholes.

In another form of this aspect of the present invention, a panel is behind the cup upper edge, whereby the panel is disposed between the buttons and the skin of a woman wearing the garment.

In still another of this aspect of the present invention, a second layer of material is along the blouse neckline and adapted to hide indications of the first and second attachment through the blouse.

In yet another of this aspect of the present invention, lace is along the upper edge of the cups.

DETAILED DESCRIPTION OF THE INVENTION

Figure 1:
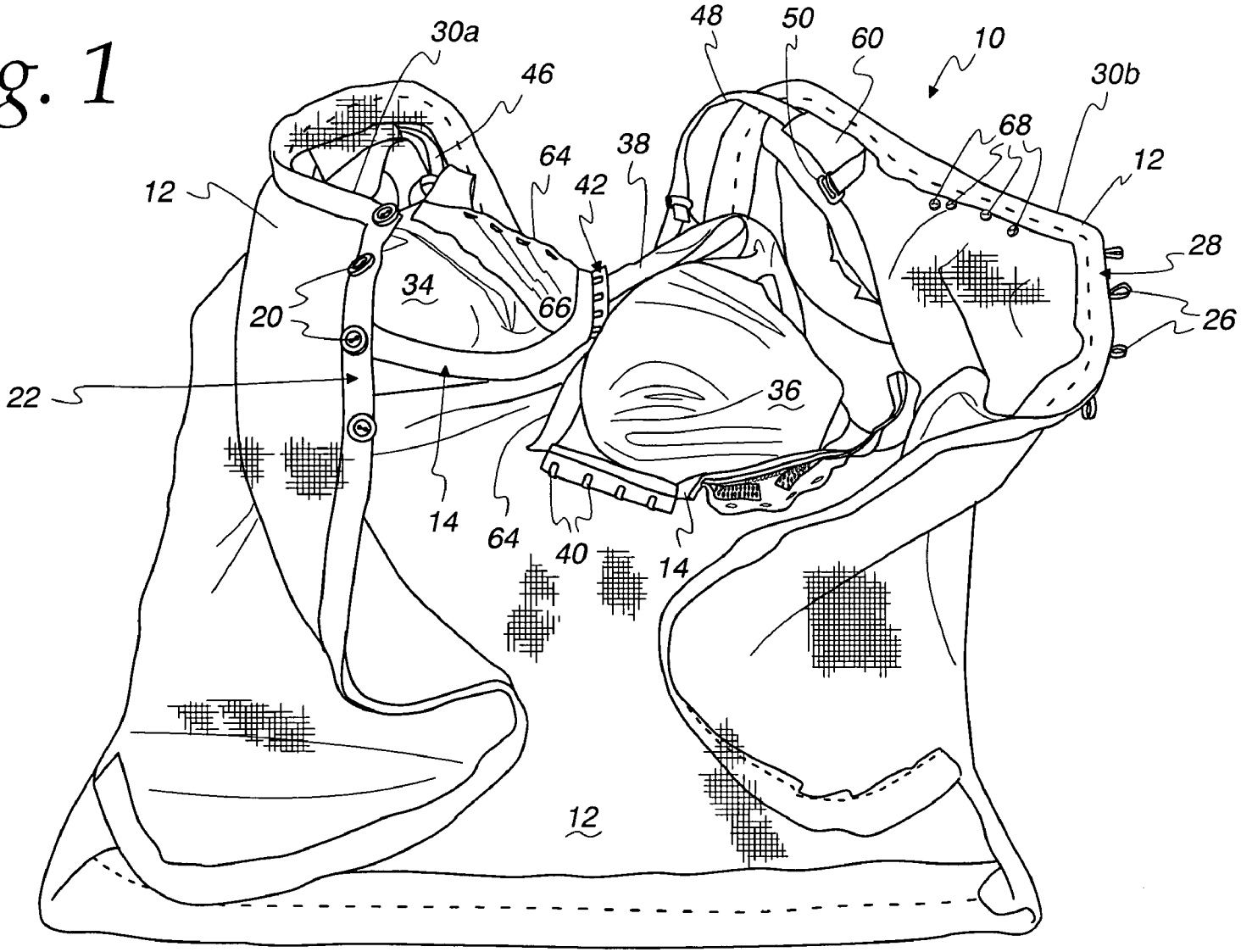
FIG. 1 is a perspective view of one embodiment of the present invention laid on a flat surface.
Figure 2:
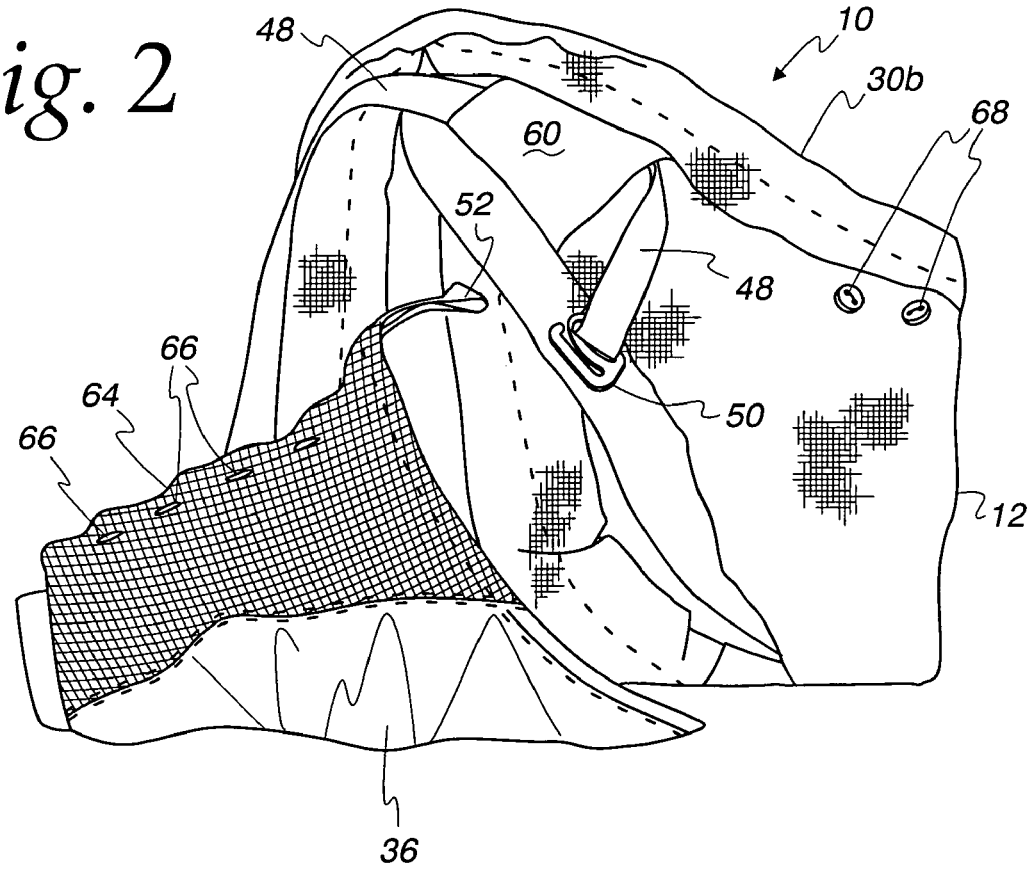
FIG. 2 is a perspective view illustrating a left shoulder portion of the garment of FIG. 1.

A garment 10 according to the present invention is illustrated in FIG. 1 as it might appear somewhat disheveled when laid on a flat surface prior to being put on by the wearer. The garment 10 includes a top or blouse 12 and a brassiere 14.

The blouse 12 is front opening, as by a plurality of buttons 20 on one front side 22 connectable with a plurality of button holes or loops 26 on the other front side 28. It should be appreciated that the particular design or fashion of the blouse 12 could be widely varied in accordance with the present invention. For example, long sleeves could be included, and a wide variety of materials and material patterns could be used, as could different securing configurations (e.g., snaps or zippers). Further, the blouse could be an integral part of a front opening dress or jumpsuit, is not required to be a separate piece from the dress or pants, and could be anything from a casual simple summer blouse, to a part of an elegant gown suitable for wearing to a formal event, to evening sleepwear or intimate apparel or undergarment to be worn privately in her bedroom. As used herein, "blouse" is intended to encompass all such variations.

At the top of the mating front sides 22, 28 is the neckline 30*a*, 30*b* of the blouse 12. When worn, the portion of the woman's chest above the neckline 30*a*, 30*b* is visible and, in accordance with the present invention, the woman may comfortably feel that the portion of her chest below the neckline 30*a*, 30*b* will be covered.

Moreover, in accordance with the present invention as further described below, the woman may feel comfortable that the blouse 12 will not gap or fall away from her body so as to reveal herself below the neckline 30*a*, 30*b*.

That is, the brassiere 14 consists of two cups 34, 36 connected by a back strap 38 and releasably connected at the front in a suitable manner, as by a set of hooks 40 and loops 42 on opposite brassiere cups 34, 36. In accordance with an advantageous aspect of the present invention, the front connection 40, 42 of the brassiere 12 may be easily connected by the wearer, including women with limited strength, etc. such as those who recently have had a mastectomy.

The brassiere 14 also includes shoulder straps 46,48 which may also be disconnected (e.g., by hooks 50 and eyes 52 such as is known in the art).

In accordance with one feature of the present invention, a passage 60 is defined on the underside of the shoulders of the blouse 12 by, for example, a panel 60 secured on two of four sides to the blouse shoulder. It should be appreciated that the brassiere 14 can therefore be readily secured inside the blouse 12 by disconnecting the brassiere shoulder straps 46, 48, snaking them through the passages 60 in the respective blouse shoulders, and then reconnecting the hooks 50 and eyes 52 (or other connecting structure) of the shoulder straps 46, 48.

When the garment 10 is secured in this manner prior to the wearer putting it on over her arms and shoulders, the garment 10, including not only the blouse 12 but also the brassiere 14 may be most conveniently put on in a single step and then readily accessed in the front to close (as described below). As previously noted, many women for a variety of reasons may find it not only difficult, but almost impossible, to put on a brassiere and/or top over their head, and thus such front closing is not only convenient, but in many cases a necessity. Moreover, it should be appreciated that the ability to do this can involve more than an everyday convenience, but it can also be a significant boost to their emotional well being (e.g., for women who have had a mastectomy and may naturally feel unsettled about changes and difficulties in their lives).

Once the garment 10 is put on over the wearer's arms and shoulders, the wearer may easily reach the cups 34, 36 in the front, position them properly, and then connect them together (via the hooks 50 and eyes 52 or whatever connecting structure is provided).

Figure 3:
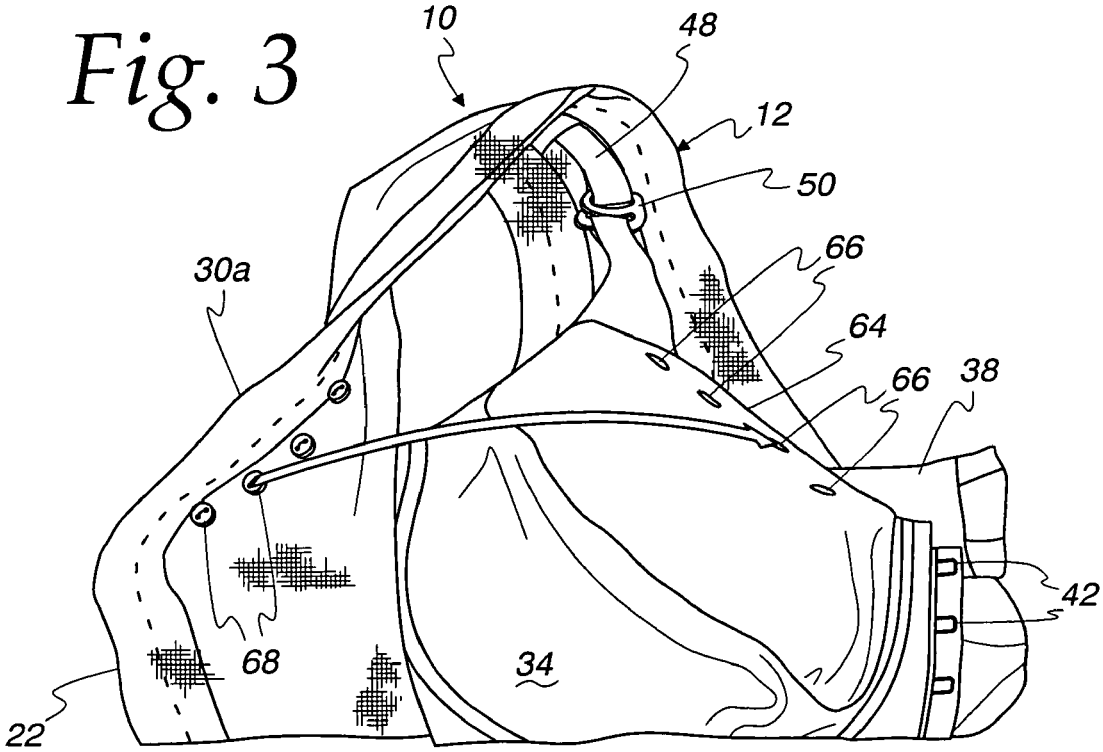
FIG. 3 is a perspective view illustrating a right shoulder portion of the garment of FIG. 1.

In accordance with the present invention, the wearer may then connect the neckline 30*a*, 30*b* of the blouse 12 directly to the upper edge 64 of the brassiere cups 34, 36. Specifically, in the illustrated embodiment, suitable buttonholes 66 are provided adjacent the upper edge 64 of the brassiere cups 34, 36 between the shoulder straps 46, 48, and matching buttons 68 are secured on the inside of the blouse 12 adjacent the neckline 30*a*, 30*b* (see particularly FIG. 3). Putting on of the garment 10 may then be completed by securing the blouse sides 22, 28 to one another, as by securing the buttons 20 in the loops 26 in the illustrated embodiment.

It should be appreciated that still other structures for securing the blouse neckline 30*a*, 30*b* to the upper edge 64 of the brassiere cups 34, 36 could be used. For example, a hook and loop structure such as Velcro® could be suitably used, as could snap connections. Moreover, it should be appreciated that, if more convenient for the wearer, the blouse buttons 68 could be secured in the brassiere buttonholes 66 before the garment 10 is put on, in which case after putting the garment on the wearer would only need to connect the brassiere cups 34, 36 to one another and then button the blouse sides 22, 28 together.

By buttoning the blouse 12 to the brassiere 14 in the above described manner, the blouse neckline 30*a*, 30*b* will be held closely to the wearer's body (i.e., to the brassiere 14 which itself is normally configured to be held closely to the body). Accordingly, a wearer may move and act normally without concern that some body motion or position will cause the blouse 12 to fall away from her body and allow others to see inside her blouse 12. Moreover, garments 10 according to the present invention allow the wearer to wear blouses 12 which have a neckline 30*a*, 30*b* which is as low as is possible (i.e., as low as the top of the brassiere 14). For some women as previously noted, this provides a fashionably and emotionally helpful option of wearing revealing clothes which make her as attractive as she wants, and make her feel that attractive as well.

It should be appreciated that the upper edge of the brassiere cups 34, 36 may also be provided with a decorative material such as lace 78 (illustrated in phantom in FIG. 4), which material may intentionally extend up far enough so as to be intentionally be seen above the neckline 30*a*, 30*b* of the blouse, to provide a striking and alluring look.

Figure 4:
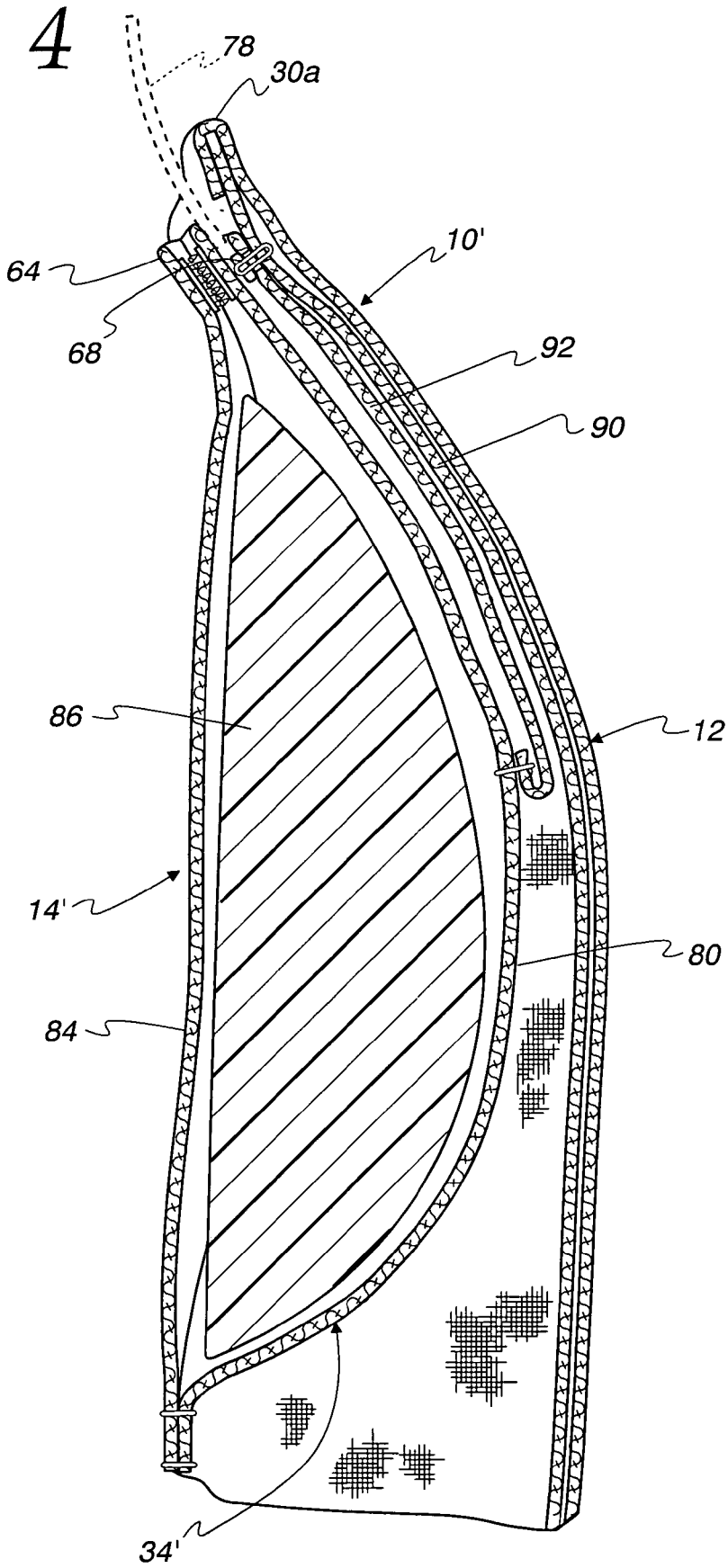
FIG. 4 is a cross-sectional view through a prosthesis supporting cup of the brassiere with the attached blouse according to an embodiment of the present invention.

FIG. 4 illustrates a brassiere 14' in which at least one cup 34' includes a front panel 80 and a back panel 82 defining a pocket therebetween for supporting a prosthesis 84 as would be used by a woman who has had a mastectomy. The blouse 12 is secured at its neckline 30*a* adjacent the top edge 64 of the cup 34' as previously described. It should be particularly appreciated from FIG. 4 that such a garment 10' allows the wearer to wear a blouse 12 having the lowest possible neckline 30*a* while also giving the wearer the comfort to not worry that others may see down inside her blouse 12.

As also illustrated in FIG. 4, the blouse 12 and/or brassiere 14' may, in accordance with the present invention, be suitable constructed so as to hide the buttons 68. That is, the blouse 12 and/or the brassiere 14' may be provided with an additional panel of material (e.g., panels 90, 92) which help to provide a smooth line to the garment 10' by protecting against externally visible bumps or stitching from the buttons 68 or other connecting structure. Moreover, such panels 90, 92 may be provided so as to protect the wearer's skin against irritation by the connecting structure.

It should thus be appreciated that garments 10 according to the present invention may provide not only an attractive appearance, but will do so in situations where currently available garments may not be suitable and where an attractive appearance is not merely nice but can be helpful to women in a fragile emotional state who are self conscious about their appearance. Further, such benefits are provided by garments which may be easily put on even by women who have physical limitations preventing them from putting on many other garments. Moreover, the ability to easily put on such garments can also be emotionally helpful to women who are facing physical challenges which might cause them to be particularly sensitive to the loss of abilities which they had previously taken for granted.

It should also be appreciated that a woman may have a wardrobe of brassieres and blouses according to the present invention, as the brassieres may be interchangeably used with different blouses. Thus, wardrobes using the present invention may be economical whereby the woman may have a lesser number of brassieres than blouses, and match an available brassiere to a particular blouse which she wishes to wear that day.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A garment for a woman, comprising:

a brassiere having a left and right cup connected by a back strap, said cups each having an upper edge, a releasable front connection between said left and right cups, left and right shoulder straps between said back strap and said left and right cups respectively, and a first complementary attachment component along the upper edge of said cups between said left and right shoulder straps; and a front opening blouse having a neckline adapted to substantially align with said upper edge of said brassiere cups, and a second complementary attachment component along said blouse neckline, said second complementary attachment component being adapted to secure to said first complementary attachment component along the upper edge of said cups.

2. The garment of claim 1, wherein said first complementary attachment component comprises a plurality of buttonholes adjacent said upper edge of said cups, said second complementary attachment component comprises buttons aligned with said buttonholes, and said buttons are adapted to secure to the aligned buttonholes.

3. The garment of claim 2, further comprising a panel secured to said cup adjacent said cup upper edge, whereby said panel is disposed between the buttons and the skin of a woman wearing the garment.

4. The garment of claim 1, wherein said left and right shoulder straps are releasably attached to said cups, and further comprising aligned passages in left and right shoulders, respectively, of said blouse wherein the left shoulder strap releasably extends through the aligned passage in the left shoulder of said blouse and the right shoulder strap releasably extends through the aligned passage in the right shoulder of said blouse.

5. The garment of claim 1, further comprising lace along said upper edge of said cups.

6. The garment of claim 1, wherein at least one of said left and right cups include a pocket for supporting a breast prosthesis.

7. The garment of claim 1, further comprising a second layer of material secured to one of said brassiere and said blouse, said second layer of material adapted to overlie said first and second complementary attachment components to hide indications of said first and second complementary attachment components through said blouse.

8. A garment for a woman, comprising:

a brassiere having a left and right cup connected by a back strap, said cups each having an upper edge and at least one of said left and right cups including a pocket for supporting a breast prosthesis, a releasable front connection between said left and right cups, left and right shoulder straps releasably attaching said back strap and said left and right cups respectively, and a first complementary attachment component along the upper edge of said cups between said left and right shoulder straps; and a front opening blouse having a neckline adapted to substantially align with said upper edge of said brassiere cups, a left passage in the left shoulder of said blouse through which said left shoulder strap releasably extends;

a right passage in the right shoulder of said blouse through which said right shoulder strap releasably extends, and a second complementary attachment component along said blouse neckline, said second complementary attachment component being adapted to secure to said first complementary attachment component along said upper edge of said cups.

9. The garment of claim 8, wherein said first complementary attachment component comprises a plurality of buttonholes adjacent said upper edge of said cups, said second complementary attachment component comprises buttons along said blouse neckline, said buttons being adapted to be aligned with said buttonholes for attachment to the aligned buttonholes when said garment is worn.

10. The garment of claim 9, further comprising a panel secured to said cup adjacent said cup upper edge, whereby said panel is disposed between the buttons and the skin of a woman wearing the garment.

11. The garment of claim 9, further comprising a second layer of material secured to one of said brassiere and said blouse, said second layer of material adapted to overlie said first and second complementary attachment components to hide indications of said first and second complementary attachment components through said blouse.

12. The method of claim 8, further comprising lace along said upper edge of said cups.

* * * * *